US008695846B2

(12) United States Patent
Letica et al.

(10) Patent No.: US 8,695,846 B2
(45) Date of Patent: Apr. 15, 2014

(54) PLASTIC PRY OFF PAINT CAN ASSEMBLY

(75) Inventors: Anton Letica, Bloomfield Hills, MI (US); John R. Selina, Brighton, MI (US); Wayne J. Harper, Macomb Township, MI (US)

(73) Assignee: Letica Corporation, Rochester, MI (US)

( * ) Notice: Subject to any disclaimer, the term of this patent is extended or adjusted under 35 U.S.C. 154(b) by 627 days.

(21) Appl. No.: 12/540,585

(22) Filed: Aug. 13, 2009

(65) Prior Publication Data

US 2011/0036804 A1 Feb. 17, 2011

(51) Int. Cl.

| | |
|---|---|
| ***B65D 43/03*** | (2006.01) |
| ***B65D 43/16*** | (2006.01) |
| ***B65D 43/06*** | (2006.01) |
| ***B65D 43/04*** | (2006.01) |
| ***B65D 39/00*** | (2006.01) |
| ***B65D 21/00*** | (2006.01) |
| ***B65D 85/62*** | (2006.01) |

(52) U.S. Cl.
USPC ..... 220/789; 220/781; 220/783; 220/798; 206/503; 206/509

(58) Field of Classification Search
USPC ..... 220/781, 783, 789, 798; 206/503, 509
See application file for complete search history.

(56) References Cited

U.S. PATENT DOCUMENTS

| | | | | |
|---|---|---|---|---|
| 834,191 | A | 10/1906 | Chambers | |
| 2,084,084 | A | 6/1937 | Greer | |
| 2,663,455 | A | 12/1953 | Sebell | |
| 3,469,735 | A | 9/1969 | Burt | |
| 4,180,179 | A | 12/1979 | Hoenig et al. | |
| 4,356,930 | A | 11/1982 | Roper | |
| 4,378,895 | A * | 4/1983 | Woinarski | 220/789 |
| 4,397,404 | A | 8/1983 | Blanchette | |
| 4,458,825 | A | 7/1984 | Holota | |
| 4,512,494 | A | 4/1985 | Von Holdt | |
| 4,530,442 | A | 7/1985 | Vogel, Jr. et al. | |
| 4,619,373 | A | 10/1986 | Galer | |
| 4,667,843 | A | 5/1987 | Galer | |
| 606,838 | A | 7/1989 | Heins | |
| 5,097,977 | A | 3/1992 | Straub | |
| 5,181,626 | A | 1/1993 | Daenen et al. | |
| 5,255,816 | A * | 10/1993 | Trepp | 220/529 |
| 5,307,949 | A | 5/1994 | Von Holdt, Jr. | |
| 5,568,879 | A | 10/1996 | Kovathana | |
| 5,758,971 | A | 6/1998 | Goglio et al. | |
| 5,842,593 | A | 12/1998 | von Holdt | |
| 6,250,494 | B1 | 6/2001 | Diamond | |
| 6,588,618 | B1 * | 7/2003 | Davis | 220/254.7 |
| 6,964,348 | B2 | 11/2005 | Breimon et al. | |
| 2003/0168465 | A1 * | 9/2003 | Breimon et al. | 220/783 |
| 2006/0043095 | A1 * | 3/2006 | Maholm et al. | 220/701 |

* cited by examiner

*Primary Examiner* — Anthony Stashick
*Assistant Examiner* — Andrew T Kirsch
(74) *Attorney, Agent, or Firm* — Young Basile Hanlon & MacFarlane PC

(57) ABSTRACT

An all plastic paint container assembly comprising a container, a ring assembly attached to the rim of the container and a pry-off plastic closure having a dual sealing arrangement with the ring member and an undercut lock at a location which provides maximum circumferential area. Containers of this design can be stacked both with and without the ring members attached. Three embodiments are disclosed, providing double and triple closure locks and multiple seals.

1 Claim, 5 Drawing Sheets

PLASTIC PRY OFF PAINT CAN ASSEMBLY

FIELD OF THE INVENTION

This invention relates to containers and more particularly to a container assembly which is particularly well suited for paint and which comprises a pry off plastic closure sealingly nested into a ring attached to the top rim of a container.

BACKGROUND OF THE INVENTION

Paint cans and lids have been traditionally been made of steel. There are a number of disadvantages associated with steel paint cans including cost; weight, a propensity to rust, and disposal issues.

As a result, a number of steps have been taken toward the development of plastic container assemblies for paint. In general, such an assembly comprises the container itself, an annular ring adapted to be attached to the top rim of the container and defining an upwardly opening U-shaped channel to receive a closure, and a closure or lid having an annular feature which is formed to complementally fit into the upwardly opening U-shaped channel in the ring member to produce a seal. An example is shown in U.S. Pat. No. 6,588,618 assigned to Letica Corporation of Rochester, Mich.

SUMMARY OF THE INVENTION

The present invention provides a container assembly of the type generally described above but having a number of features and advantages over prior plastic container assemblies.

According to a first aspect of the invention, the ring assembly adapted to be attached to the top rim of the container has an upwardly opening U-shaped channel defined by inner and outer radially spaced concentric walls. The closure comprises an inner deck portion and a peripheral portion defining annular inner, middle, and outer walls, all made integral with one another by radial bridge sections, and defining both an outermost upwardly opening U-shaped channel at an innermost downwardly opening or "inverted" U-shaped channel. The upwardly opening channel defines a smooth, annular surface which is complemental to and fits nestingly within the upwardly-opening U-shaped channel of the ring member whereas the inverted U-shaped channel receives the upstanding innermost end wall of the ring member and provides seals on both inner and outer surfaces thereof to prevent paint or other contained fluid from entering the space between the two complemental U-shaped channels.

In addition, an undercut-type lock is formed between the outermost wall of the closure and the outer wall of the ring assembly thereby locating the lock in that portion of the overall combination of components which has the largest circumferential dimension thereby giving the lock greater surface area and improving drop test performance. In addition, locating the lock in this area takes advantage of the natural spring effect between the ring member and the outer wall of the closure thereby making it easier to remove the closure. However, in an alternative embodiment, an additional lock may be provided between the inner surface of the inner ring wall and the adjacent closure wall. In this embodiment, multiple locks and multiple seals are provided. The term "lock" is used herein to refer to an undercut, interference fit between two radially adjacent plastic walls which makes disengagement of those walls from one another more difficult, but not impossible, to achieve. This term is commonly used in this manner in the plastic container technology.

In accordance with a further aspect of the invention, the bottom of the pail or container is formed with a downwardly projecting annular tongue and, radially outwardly thereof, an annular groove. The radius of the annular groove is such that, when two such containers are stacked atop one atop the other, before the ring member is attached to the container, the top rim of the container fits into the grove and enhances the stackability of the two containers. At the same time, the downwardly projecting annular tongue fits into a radial gap between the closure and a step formed between the peripheral portion of the ring member and the outer wall of the ring member so as to provide a laterally stable stacking relationship between two containers when a ring member is attached to the bottommost container in the stack. Therefore, as a result of the invention, assembled containers can be stacked both with and without attached ring members while lateral stability in the stack is provided.

BRIEF DESCRIPTION OF THE DRAWINGS

The description herein makes reference to the accompanying drawings wherein like reference numerals refer to like parts throughout the several views, and wherein.

DETAILED DESCRIPTION OF THE ILLUSTRATIVE EMBODIMENT

Figure 1:
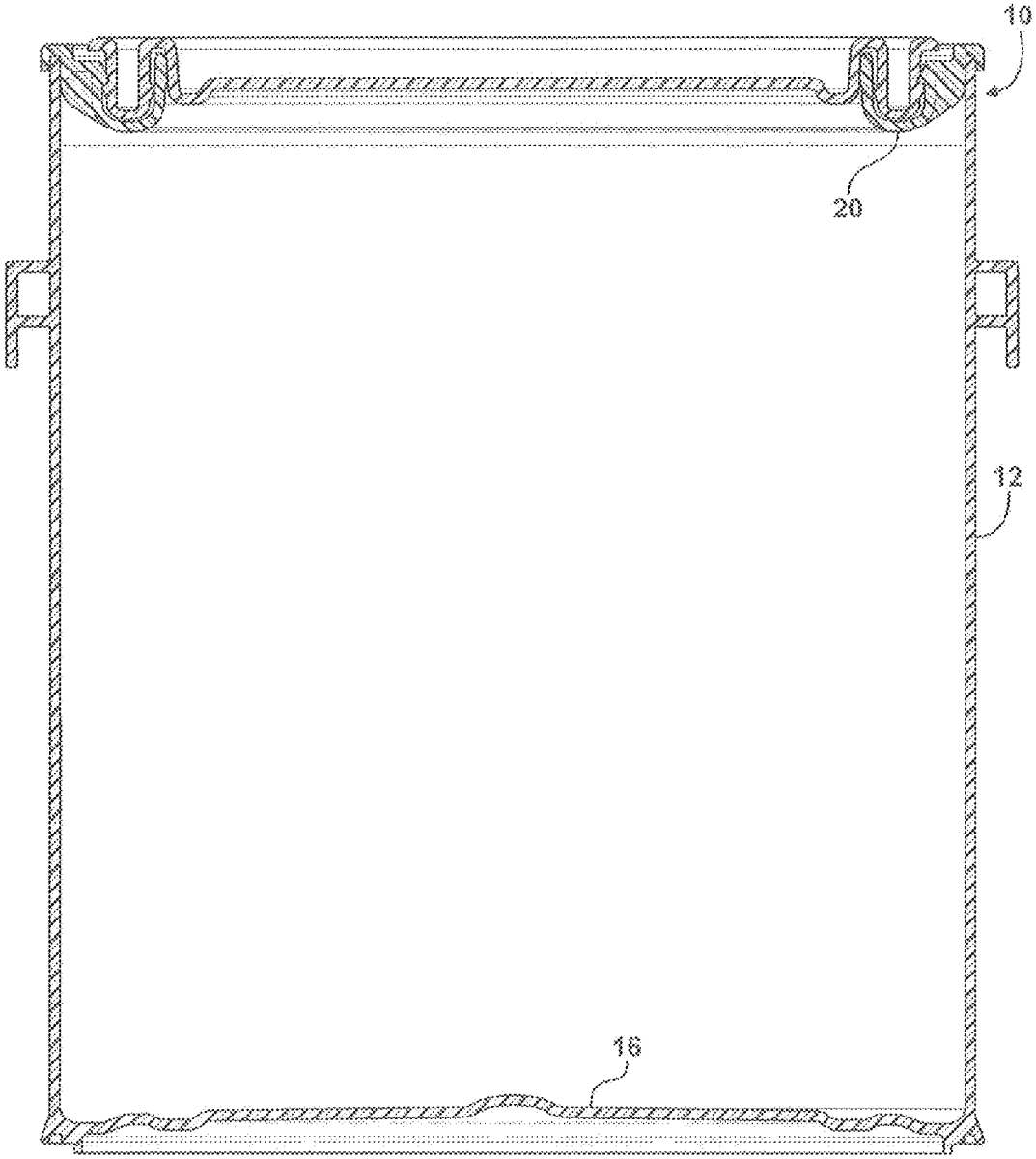
FIG. 1 is a side view of a container assembly embodying the invention.

Referring to FIG. 1, there is shown a container assembly 10 comprising a molded plastic; one gallon cylindrical container 12 having an essentially non-tapered, cylindrical side wall 14 and an integral closed bottom 16. The container side wall 14 terminates in an embedded upper peripheral rim 18. The container assembly 10 is, in this instance, made entirely of high density polyethylene but it will be apparent to those skilled in the art that other plastic materials and blends thereof may be used.

In accordance with the invention, an annular ring member 20 is secured to the top rim 18 of the container 12 by means of adhesive. Again, other attachment methodologies may be used including spin welding, heat welding and snap-light interference fits.

The ring member 20 comprises a peripheral portion 22 having a downwardly opening annular groove 23 which is adapted and sized to receive the upper rim portion 18 of the container side wall 14 therein. The ring member 20 further comprises a radially innermost portion defining an upwardly opening U-shaped channel having a radially outer annular wall 24 backed by radial bracing ribs 32 and, concentric therewith, a radially inner annular wall 26. The walls 24, 26 are made integral by means of a bight or bridge section 27. A step 28 on the inside of the peripheral portion 22 results in a recessed land 30 which leads into an undercut tab 34 on the inner surface of the outer wall 24 to provide a lock between the ring 20 and a closure 36, hereinafter described.

Figure 2:
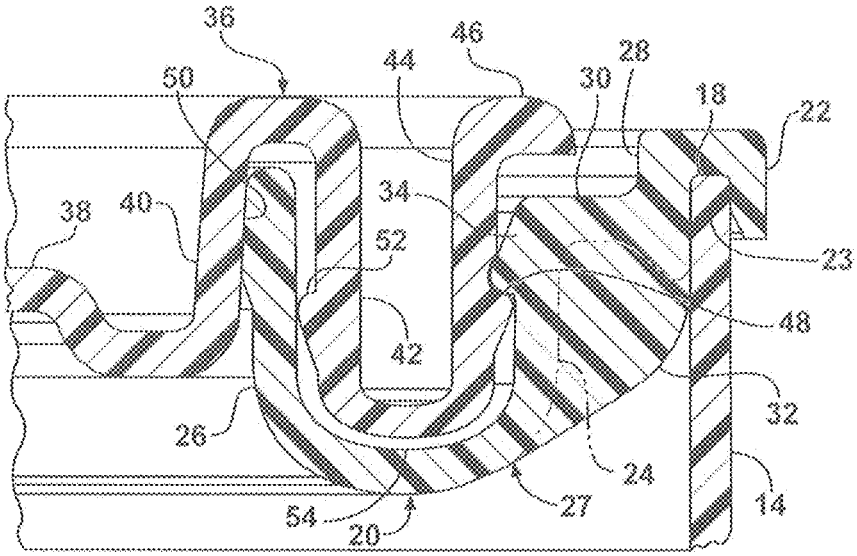
FIG. 2 is a cross-section of the closure detail for the container assembly of FIG. 1.

Continuing with the description of FIG. 2 embodiment, the injection molded plastic closure 36 comprises an inner planar deck portion 38 and a series of radially spaced annular walls 40, 42 and 44 of which wall 40 is the innermost wall, wall 42 is a middle wall and wall 44 is the outermost wall. Wall 44 terminates in a flange 46 which, when the closure 36 is installed in the ring member 20, exhibits a radial clearance from the step 28 as well as a uniform 360° vertical clearance from the land 30 such that a prying tool may be inserted between the flange and the ring member to pry the closure 36 from the ring member to access the contents of the container 12.

The complemental second half of the undercut lock is provided by means of a tab 48 formed on the outer surface of the outer closure wall 44 so as to interfit with the tab 34 to provide an undercut lock of large circumferential dimension when the upwardly opening U-shaped channel 36 is complementally interfit into the upwardly opening U-shaped channel of the ring member 20.

A first seal 50 is formed by firm radial contact between the radially innermost wall 26 of the ring member 20 and the inner surface of the inner radially innermost wall 40 of the closure 36. A second seal is formed by close and firm radially contacting relationship between the inner surface of the innermost wall 26 of the ring member 20 and an annular tab 52 on the middle wall 42 of the closure 36. This dual seal arrangement prevents paint from entering into the space 54 between the ring member 20 and the closure 36 thus providing a cleaner paint-free closure when it is first removed from the container by the end user. The closure channel does not bottom out in the ring channel.

Figure 4:
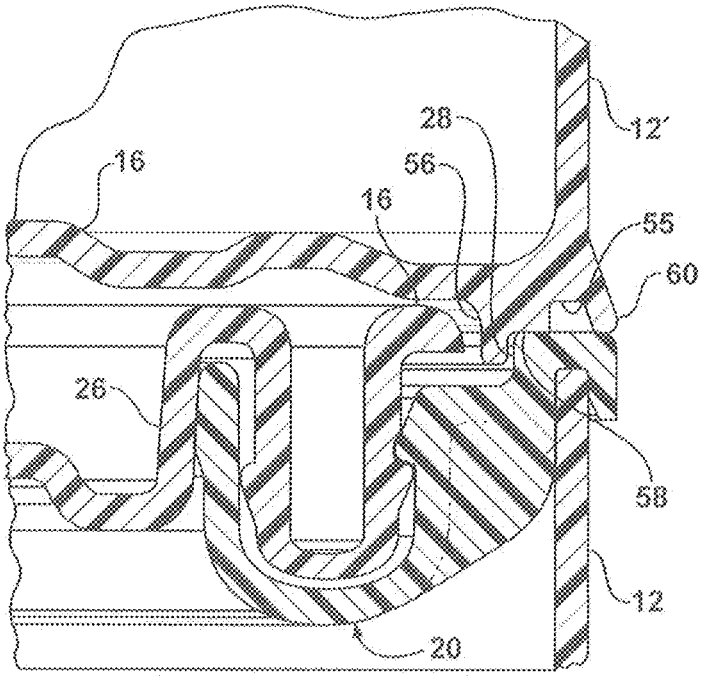
FIG. 4 is a detail of the stacked containers showing the stackability of the containers with a ring member attached.
Figure 3:
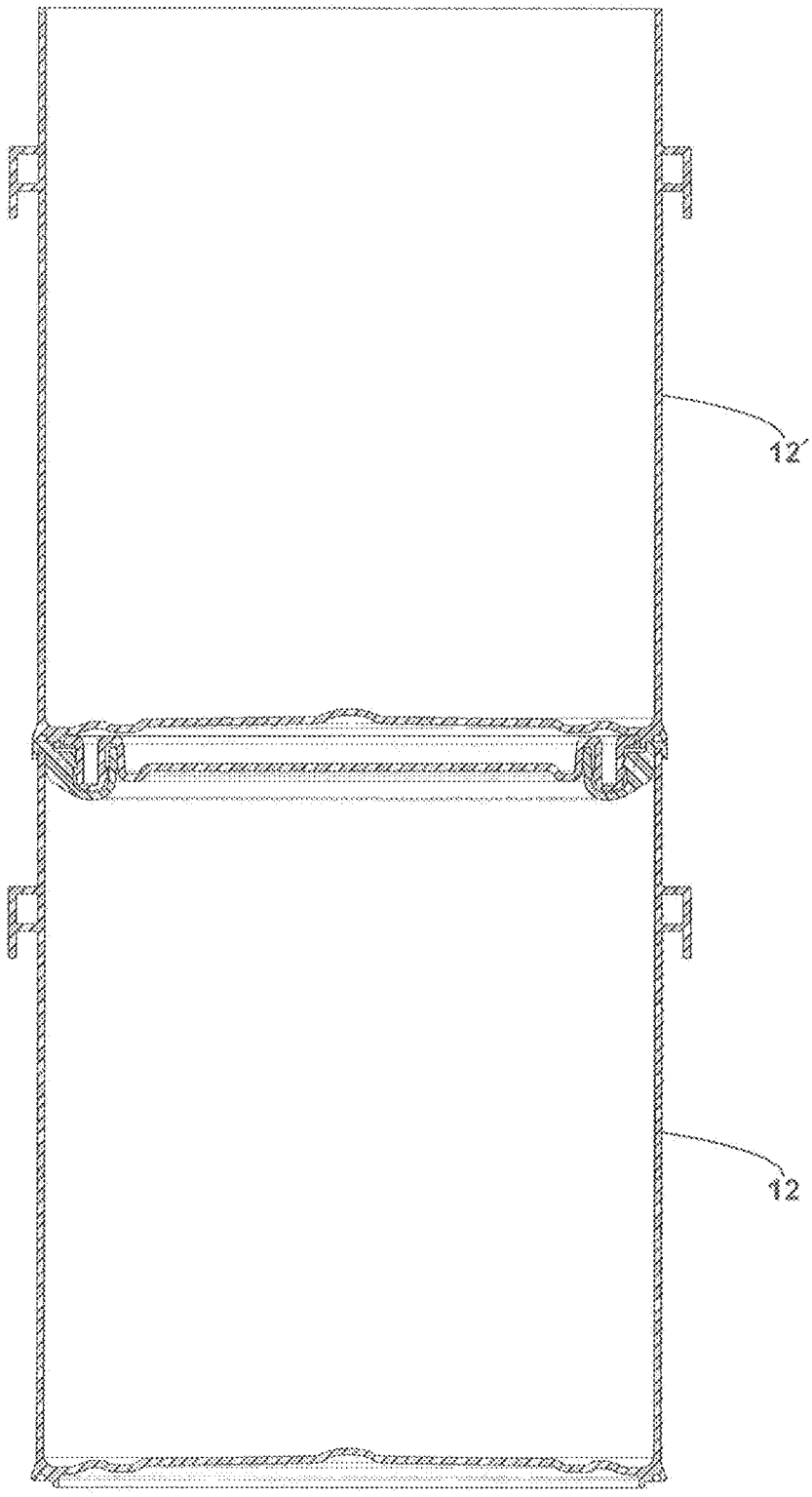
FIG. 3 is aside view showing stacked containers.
Figure 5:
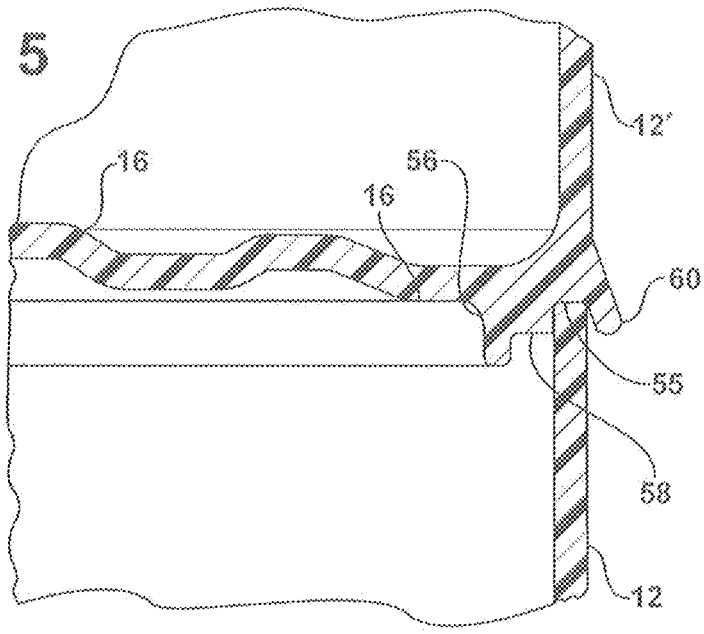
FIG. 5 is a detail of stacked containers before the ring member is attached.

Referring now to FIGS. 3, 4 and 5, the relationship between two containers 12, 12' in stacked relationship on the two conditions will be illustrated and described. In FIG. 4, the lower container 12 has the ring member 20 attached to the container and a closure 26 attached to the ring member 20. The bottom 16 of the uppermost container 12' is shown to exhibit an upwardly opening groove 55 and, radially inwardly thereof, a land 58 which is adjacent a downwardly projecting annular tongue 56. As shown in FIG. 4, with the ring member 20 attached to the container 12, the downwardly projecting tongue 56 fits into the radial clearance between the flange 46 and the step 28 to provide lateral stability between the two containers in the stacked relationship.

As shown in FIG. 5, when containers are stacked without the ring member 20 being attached to either containers, the top rim 18, being of the same radial dimension as the groove 55, fits into the groove such that the outermost ring 60 provides lateral stability preventing movement between the two stacked containers.

Figure 6:
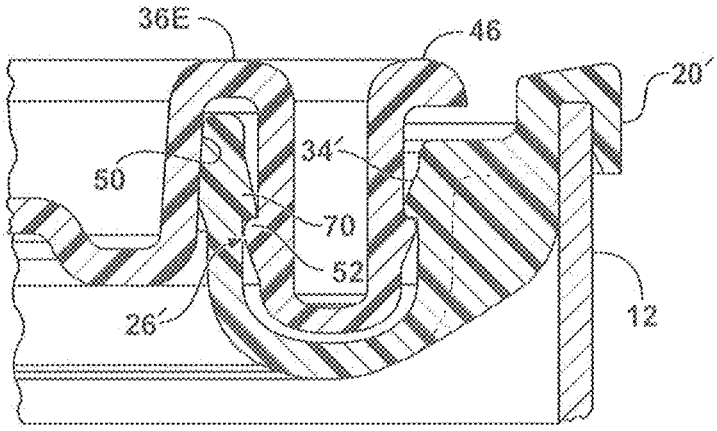
FIG. 6 is a sectional view of an alternative embodiment providing a double lid lock.
Figure 7:
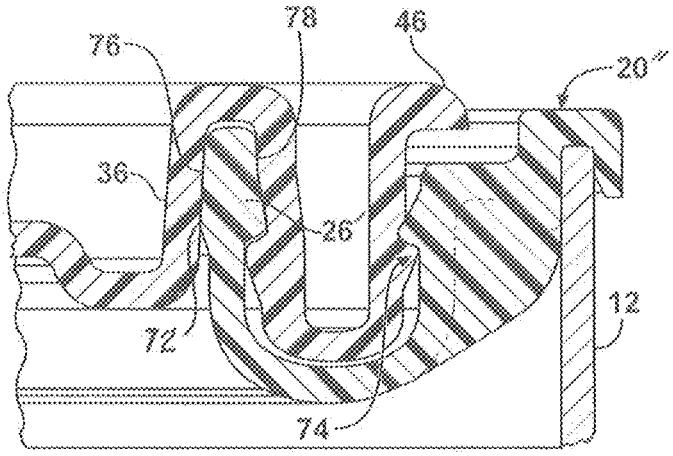
FIG. 7 is a sectional view of a second alternative embodiment with a double lid lock.
Figure 8:
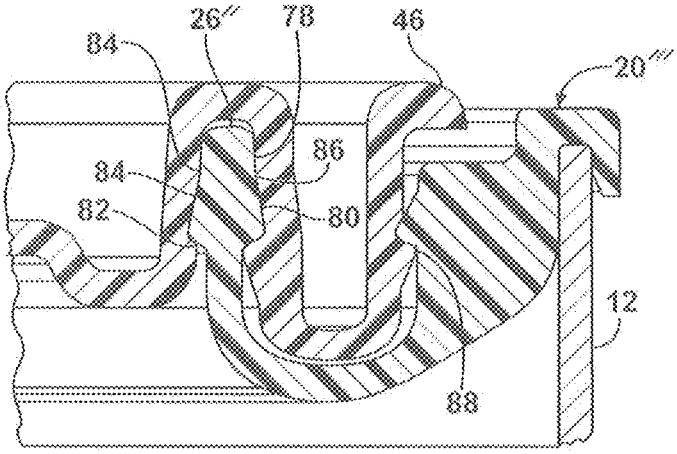
FIG. 8 is a sectional view of a third alternative embodiment with a triple lid lock.

FIGS. 6, 7 and 8 illustrate alternative embodiments of the invention providing additional closure (lid) locks and seals. In all cases, the container 12 remains unchanged, as do the details of how the ring members 20', 20" and 20'" are attached to the container 12.

Referring to FIG. 6, the ring member 20' has the lock 34' identical to lock 34 of the FIG. 2 embodiment, but has a lock/seal area 70 formed on the inside surface of the outer annular wall 26'. The closure 36 has the serpentine, double-channel periphery like the FIG. 2 embodiment, but the lock feature 52 here interacts with the feature 70 on the ring to provide a second lid lock as well as an additional seal to seal area 50.

Referring to FIG. 7, the container 12 receives a ring structure 20" and the ring structure 20" again receives the closure (lid) 36. Like the FIG. 6 embodiment, locks are provided at both 72 and 74. However, the upstanding annular wall 26' is made thicker and seals with both inside surfaces of the lid 36 when the lid is fully engaged with the ring 20"; i.e., the seals are at 76 and 78.

In FIG. 8, the ring 20'" has undercuts 80 and 82 on both sides of the wall 26", thus providing a triple lid lock as well as a triple seal; i.e., seals are formed between the closure (lid) and ring at all of 84, 86 and 88.

It will be understood that the invention has been described with reference to a specific embodiment thereof and with various features, proportions and dimensions of the embodiment shown can be changed without departing from the spirit and scope of the invention.

What is claimed is:

1. A stackable plastic container assembly comprising:

a plastic pail having a bottom and a cylindrical sidewall terminating in an unflanged top rim;

a separately molded snap ring attachable to said pail and having a peripheral structure having a stepped top surface defining a radially outboard upper top surface portion and a radially inboard lower surface portion contiguous to said upper surface portion, said peripheral structure defining an inverted U-shaped channel adapted to sealingly receive said top rim therein, an upwardly opening U-shaped closure-receiving annular channel radially inboard of said peripheral structure immediately radially inboard of said lower surface portion; said pail assembly further comprising a pry-off closure having a flat recessed central deck portion and, integral with said deck portion, a peripheral U-shaped annular channel which fits complementally and sealingly into the upwardly opening U-shaped channel of said snap ring to seal said pail;

wherein the peripheral U-shaped annular channel of the closure has a radially outer wall which terminates in a radially outwardly projecting pry flange that, when said closure is sealingly attached to said snap ring, overlies said lower surface portion in vertically spaced-apart relationship therewith, and further wherein said complementally-fitting snap ring and closure U-shaped channels have an undercut lock formed on the mating outermost surfaces thereof to provide a locking function securing said closure to said snap ring;

wherein said pail bottom has formed therein a radially inner and downwardly extending annular tongue and a radially outer annular, downwardly opening annular groove; said tongue being dimensioned to fit into said snap-ring stepped top surface between the pry flange and the upper top surface portion when said pail is stacked upon an identical pail with an attached snap-ring; and said groove being dimensioned to receive said top rim when stacked upon a similar pail without a snap-ring attached thereto.

* * * * *